US005381588A

United States Patent [19]

Nelson

[11] Patent Number: 5,381,588

[45] Date of Patent: Jan. 17, 1995

[54] RETAINING AND DISPLAY DEVICE

[76] Inventor: Jeffrey A. Nelson, 480 S. 9th St., Apartment E205, Quakertown, Pa. 18951

[21] Appl. No.: 59,551

[22] Filed: May 11, 1993

[51] Int. Cl.[6] ..... B65D 77/00

[52] U.S. Cl. ..... 24/30.5 S; 24/343; 24/563; 24/DIG. 29

[58] Field of Search ..... 24/563, 555, 528, 570, 24/535, 336, 30.5 S, 590, 240, 3 K, D28, D29, 647

[56] References Cited

U.S. PATENT DOCUMENTS

| | | | |
|---|---|---|---|
| 867,255 | 10/1907 | Dietz | 24/3 K |
| 1,679,588 | 8/1928 | Spraul | 24/3 K |
| 2,779,076 | 1/1957 | Schenck, Sr. | 24/336 |
| 3,170,213 | 2/1965 | Thomas, Jr. | 24/30.5 S |
| 3,606,651 | 9/1971 | Goodman . | |
| 4,010,879 | 3/1977 | George et al. | 24/336 |
| 4,644,610 | 2/1987 | Fish | 24/30.5 S |
| 4,697,312 | 10/1987 | Freyer | 24/30.5 S |
| 4,914,789 | 4/1990 | Pedersen | 24/30.5 S |
| 5,044,051 | 9/1991 | Klein | 24/590 |

FOREIGN PATENT DOCUMENTS

| | | | |
|---|---|---|---|
| 1353431 | 1/1964 | France | 24/30.5 S |
| 1234618 | 2/1967 | Germany | 24/30.5 S |
| 3159692 | 7/1991 | Japan | 24/DIG. 29 |

*Primary Examiner*—Victor N. Sakran

*Attorney, Agent, or Firm*—Eckert Seamans Cherin & Mellott

[57] ABSTRACT

Disclosed is a device designed to retain a pair of sock or other paired items of clothing together during the washing or drying thereof. The retaining device is also adapted to be used to display a pair of socks or other paired items of clothing on display racks in stores selling such items of clothing. Also, disclosed is a holder dispenser for storing a number of the retaining devices in the laundry and which allows the retaining devices to be removed one at a time, as needed.

7 Claims, 2 Drawing Sheets

FIG. 1.
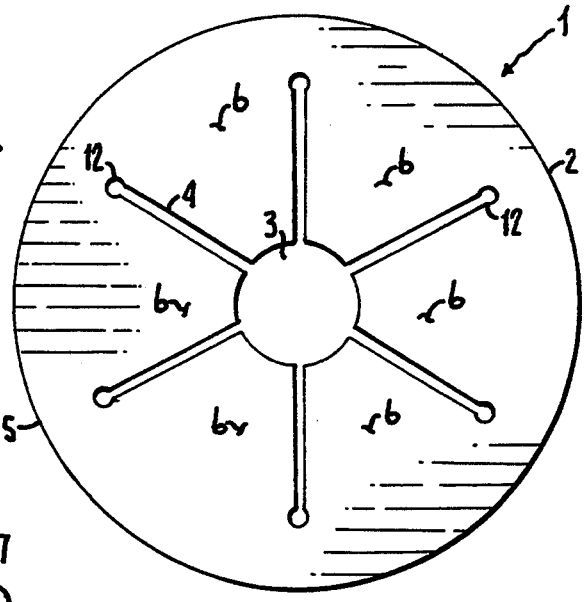
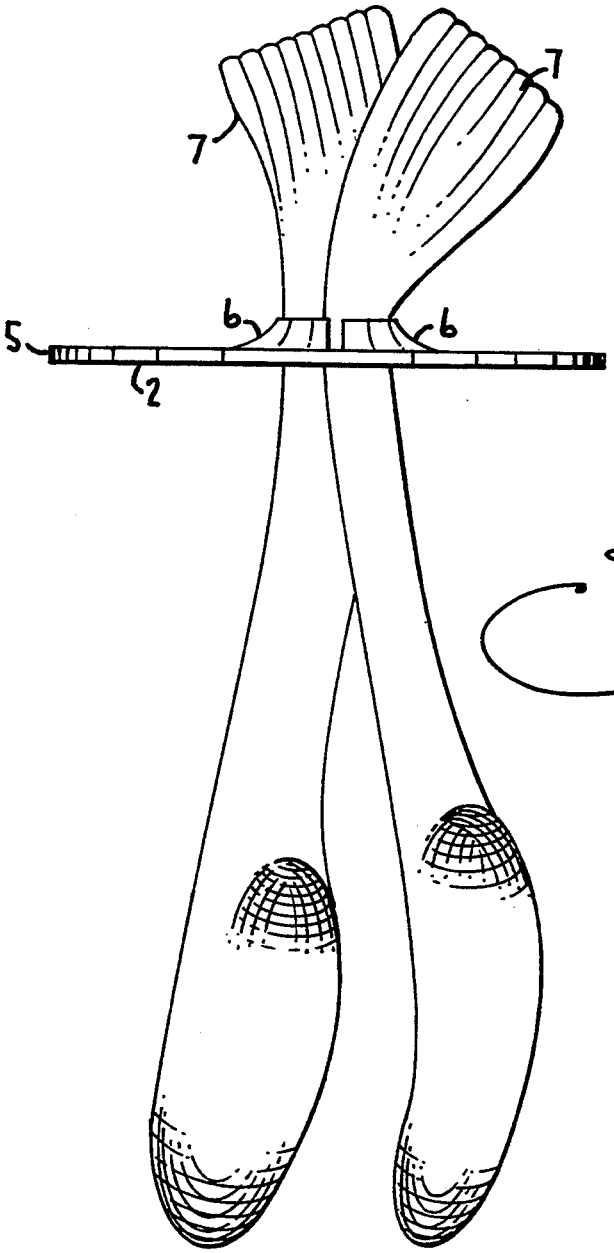
FIG. 2.

RETAINING AND DISPLAY DEVICE

BACKGROUND OF THE INVENTION

This invention relates to a device designed to retain a pair of socks or other paired items of clothing together during the washing and drying thereof. The device is also adapted to be used to display a pair of socks or other paired items of clothing on display racks in stores selling such items of clothing.

Anyone that has laundered clothing has experienced the frustration of finding one or more socks or other clothing items used and laundered in pairs, missing after the washing or drying cycles. In many cases the missing sock is adhering to a hidden surface of the rotating drum of the washing machine or the dryer and turns up in a subsequent washing and drying cycle. However, in many cases it is never found. This problem is especially acute where one does the laundry at a public laundromat and discovers the missing sock or other item of clothing only after returning home from the laundromat.

Equally frustating is having to match up pairs of socks or other clothing items of smilar shape and color that all have been included in a single load of laundry.

U.S. Pat. No. 3,606,651 issued in 1971 to Robert H. Goodman discloses a hoop-like plastic or metal ring having prongs or other projections to surround a pair of socks or other items of clothing during washing and drying thereof. The device shown in U.S. Pat. No. 3,606,651, is relatively small and easily dislodged from the clothing during the vigorous agitation during the washing cycle and could easily enter and damage the washing machine or dryer mechanism. In addition, the device disclosed in the patent to Goodman can not be used with clothing items of different thicknesses, since the ring is of a fixed, predetermined diameter.

SUMMARY OF THE INVENTION

It is therefore an object of this invention to provide a device suitable for retaining a pair or socks or other items of clothing together during the washing and drying thereof.

It is another object of this invention to provide a device suitable for retaining a pair of socks or other items of clothing together during the washing and drying thereof that is able to accommodate items of clothing of many different thicknesses.

It is a still further object of this invention to provide a device suitable for retaining a pair of socks or other items of clothing together during the washing and drying thereof that is not easily dislodged during the washing and drying cycles and incapable of being drawn into the mechanism of the washing machine or the dryer.

It is another object of this invention to provide a device that can be used to display a pair of socks or other paired items of clothing on a display rack in stores and which can be easily adapted by the customer to a retaining device for retaining the socks or other items of clothing together during the washing and drying thereof.

These and other objects of this invention can be attained by a device suitable for retaining socks or other items of clothing together during the washing or drying thereof comprising a disc of sheet plastic or other similar material having a central opening and a plurality of slots extending radially outwardly from said opening towards the outer periphery of the disc.

BRIEF DESCRIPTION OF THE DRAWINGS

FIG. 1 is a front elevational view of one embodiment of the retaining device of this invention.

FIG. 2 is a side view of the retaining device shown in FIG. 1.

DESCRIPTION OF THE PREFERRED EMBODIMENTS

Figure 3:
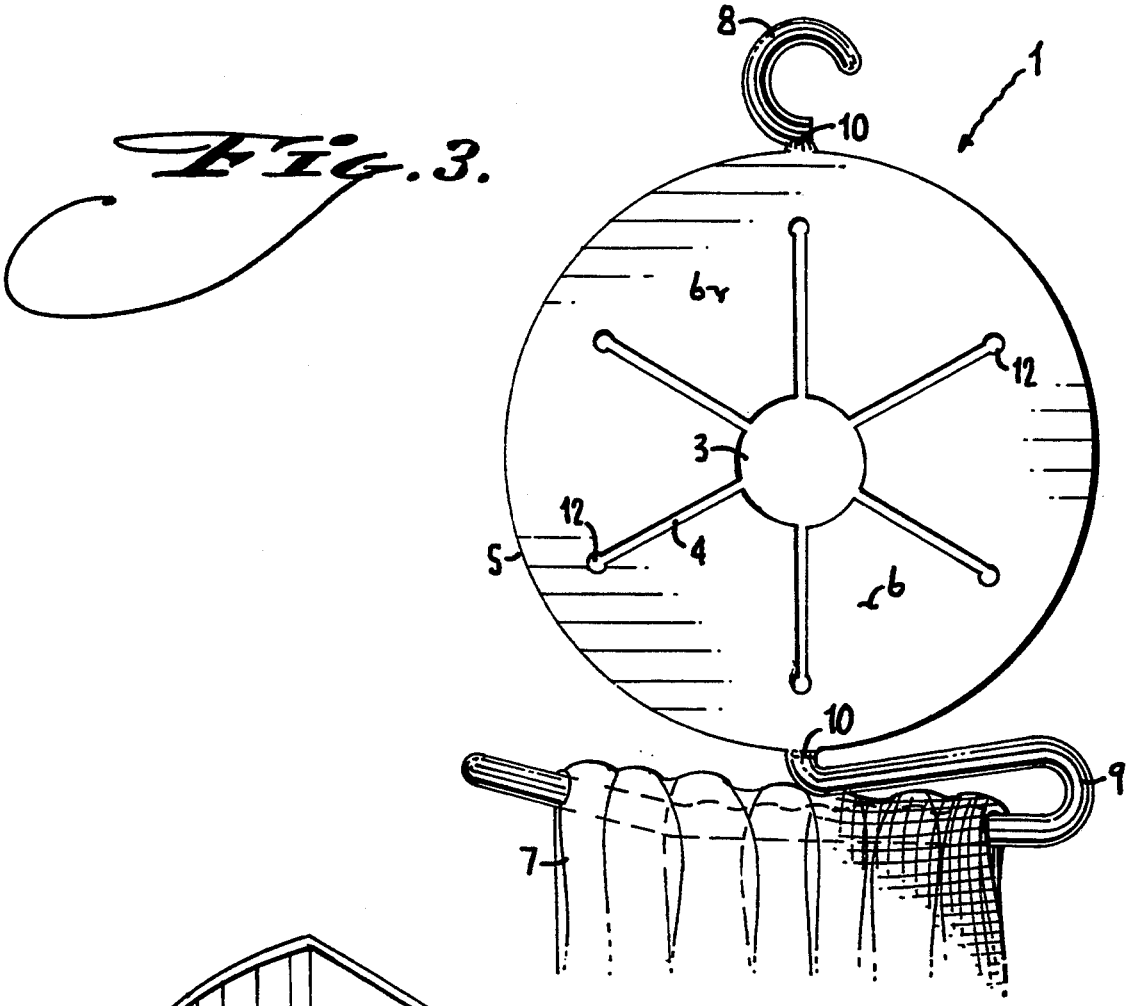
FIG. 3 is a front elevational view of a second embodiment of the retaining device of this invention, used also as a display for items of clothing in a store.

FIGS. 1 and 2 illustrate one preferred embodiment of the retaining device of this invention. As shown in FIG. 1, the retaining device 1 is comprised of a circular disc 2 cut from a thin plastic sheet or similar sheet material. The disc 2 is provided with a central circular opening 3 and a plurality of equal spaced slots 4 extending radially outwardly from the central circular opening 3 towards the outer periphery 5 of the the disc 2 to provide a plurality of somewhat flexible tabs 6.

As illustrated in FIG. 2, a pair of dirty socks 7 or other paired items of clothing are inserted into the central circular opening 3 of the disc 2 and pulled part way through the opening 3, causing the flexible plastic tabs 6 between the slots 4 to flex slightly upwardly in the direction of the insertion and thereby grip and lock the socks 7 or clothing items tightly within the central circular opening 3 and the ends of the tabs 6 of the disc 2. The retaining device 1 and the pair of socks 7 are then laundered and dried together.

A specific example of the retaining device 1 of the embodiment shown in FIGS. 1 and 2, is a circular plastic disc about 3.5 inches (89 mm.) in diameter, cut from a polyethylene plastic sheet about 0.063 inches (1.6 mm.) thick, having a central circular opening 3 about 0.75 inches (19 mm.) in diameter. The disc 2 has six slots each about 0.03 inches (0.8 mm.) wide and 1.75 inches (44 mm.) long and terminating in a circular diverticula 12, about 0.06 inches (1.5 mm.) in diameter, as shown in FIG. 1. The diverticula 12 prevent the slots 4 from tearing outwardly towards the periphery of the disc 2 during use.

FIG. 3 illustrates another embodiment of the retaining device 1 of this invention that can be used not only to retain a pair of socks 7 during the washing and drying thereof but is also used as a display holder to display socks 7 or other paired items of clothing in a store selling such items of clothing. As shown in FIG. 3, the circular disc 3 is provided with a top or first hook member 8 adapted to hang from a display rod of a display rack and a bottom or second hook member 9 adapted to hold and retain a pair of socks 7 or other paired items of clothing for display in a store. The first hook member 8 and the second hook member 9 are preferably formed of plastic integrally with the circular disc 2 and scored with a groove 10 close to the outer periphery 5 of the circular disc 2, which will allow the purchaser of the socks to easily snap off both hook members 8 and 9 and use the retaining device 1 for retaining the socks 7 during their laundry as described above. If desired, the face of the retaining device 1 may be printed with the trademark of the clothing being displayed or other printed material.

Figure 4:
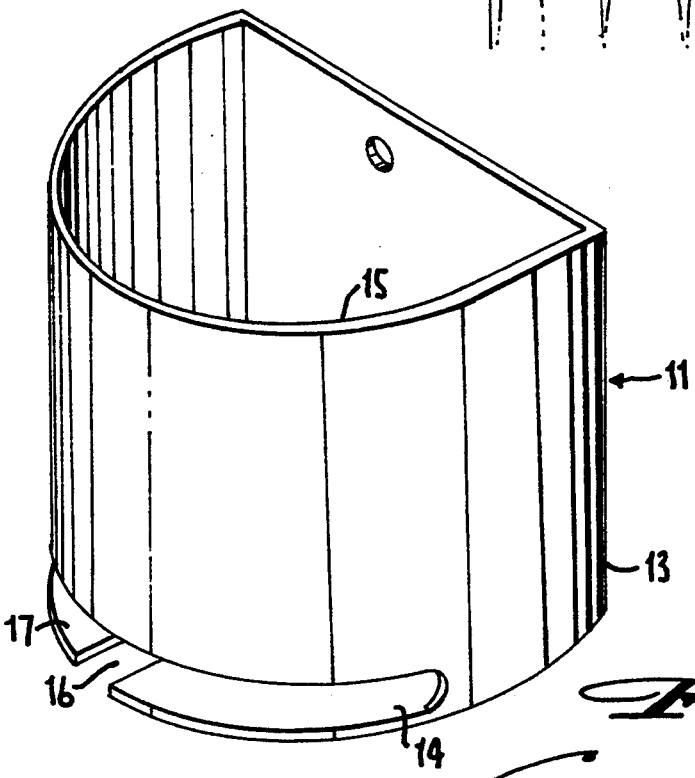
FIG. 4 is an isometric view of a holder and dispenser for the retaining devices of this invention, as illustrated in FIGS. 1 and 2.

Since the retaining devices 1 are reusable, the retaining devices 1 may be conveniently stored in the laundry room in a dispenser holder 11, as shown in FIG. 4. The dispenser holder 11 is an open top box 13 made of plastic or other suitable material and adapted be secured to a vertical wall surface and to hold a stack of retaining devices 1. The bottom wall 14 and bottom portion of the curved front wall 15 of the dispenser holder 11 are provided with slots 16 and 17 which allows the user to insert an index finger in the slot 16 in the bottom wall 14 and withdraw a retaining device 1 one at a time from the bottom of a stack of retaining devices 1 contained in the dispenser holder 11 through slot 17 in the bottom portion of the front wall 15 of the dispenser holder 11. After use in the laundry, the retaining device 1 in returned to the top of the stack in the dispenser holder 11.

While I have described my invention by illustrating and describing two preferred embodiments of the invention, I have done so by way of example, and am not to be limited thereby as there are modifications and adaptions that could be made within the scope of my invention.

I claim:

1. A device, for retaining items of clothing together during the washing or drying thereof, comprising:

a disc of sheet material having a central opening;

a plurality of slots extending radially outwardly from said opening towards the other periphery of said disc; and, a means hook member to hang from a display rod, the hook member being formed of plastic integrally with the disc and scored with a groove close to said other periphery of the disc, wherein the hook member is easily detachable, which permits a retail purchaser of the device to permanently remove the hook member after purchase to use the disc for retaining items of clothing together during washing or drying.

2. The device of claim 1 in which the central opening is circular.

3. The device of claim 1 in which the outer periphery of the disc is circular.

4. The device of claim 1 in which the slots are six in number.

5. The device of claim 1 in which the ends of the slots closest to the outer periphery of the disc are diverticula.

6. The device of claim 1, wherein said hook member means comprises a first hook member to hang from a display rod; and, a second hook member for holding and displaying items of clothing.

7. The device of claim 6, comprising both of said first hook member and said second hook member; and wherein both of said hook members are detachable from said disc.

* * * * *